US009144282B2

(12) United States Patent
Leuty

(10) Patent No.: US 9,144,282 B2
(45) Date of Patent: Sep. 29, 2015

(54) METAL PURSE WITH INTERIOR ELECTROLUMINESCENT LIGHTING SYSTEM

(71) Applicant: Tamara Ann Leuty, Las Vegas, NV (US)

(72) Inventor: Tamara Ann Leuty, Las Vegas, NV (US)

( * ) Notice: Subject to any disclaimer, the term of this patent is extended or adjusted under 35 U.S.C. 154(b) by 240 days.

(21) Appl. No.: 13/666,022

(22) Filed: Nov. 1, 2012

(65) Prior Publication Data

US 2013/0107503 A1 May 2, 2013

Related U.S. Application Data

(60) Provisional application No. 61/554,078, filed on Nov. 1, 2011, provisional application No. 61/554,262, filed on Nov. 1, 2011.

(51) Int. Cl.

| | |
|---|---|
| ***A45C 15/06*** | (2006.01) |
| ***A45C 3/02*** | (2006.01) |
| ***A45C 3/06*** | (2006.01) |
| ***A45C 5/02*** | (2006.01) |
| *A45C 5/03* | (2006.01) |

(52) U.S. Cl.

CPC . *A45C 15/06* (2013.01); *A45C 3/02* (2013.01); *A45C 3/06* (2013.01); *A45C 5/02* (2013.01); *A45C 2005/037* (2013.01)

(58) Field of Classification Search

CPC ..... A45C 15/06; A45C 3/02

See application file for complete search history.

(56) References Cited

U.S. PATENT DOCUMENTS

| | | | | |
|---|---|---|---|---|
| 3,557,854 | A | 1/1971 | Reitzel | |
| 3,609,342 | A * | 9/1971 | Wisniewski | 362/156 |
| 3,692,078 | A | 9/1972 | Reitzel | |
| 5,268,827 | A * | 12/1993 | Granneman et al. | 362/156 |
| 5,992,176 | A | 11/1999 | Arbogast | |
| 6,120,162 | A * | 9/2000 | Guerrieri | 362/155 |
| 6,132,059 | A * | 10/2000 | Leibowitz | 362/156 |
| 6,460,696 | B1 | 10/2002 | Meyer | |
| 6,796,344 | B2 | 9/2004 | Chen et al. | |
| 6,848,807 | B2 * | 2/2005 | Guerrieri | 362/155 |
| 7,412,995 | B2 | 8/2008 | Arcese | |
| 2002/0092588 | A1 | 7/2002 | Ka Fai Au et al. | |
| 2006/0037682 | A1 | 2/2006 | Reiter | |
| 2008/0295930 | A1 | 12/2008 | Arcese | |
| 2010/0263179 | A1 * | 10/2010 | Boldin | 28/100 |
| 2011/0170282 | A1 * | 7/2011 | Munoz | 362/156 |

* cited by examiner

*Primary Examiner* — Elmito Breval

(74) *Attorney, Agent, or Firm* — Richard Mark Blank, Esq.

(57) ABSTRACT

The present invention provides a metal purse having an interior electroluminescent lighting system. The metal purse includes: a first metal shell, a second metal shell, an optional handle, a closure system, an on/off switch, a battery power pack, and one or more electroluminescent light panels. The metal purse may include a clutch, a tote, a briefcase, a handbag, a shoulder bag, or a makeup bag.

19 Claims, 9 Drawing Sheets

METAL PURSE WITH INTERIOR ELECTROLUMINESCENT LIGHTING SYSTEM

RELATED APPLICATIONS

This application claims priority to U.S. Provisional Patent Application Ser. Nos. 61/554,078 and 61/554,262 both filed Nov. 1, 2011, both of which are hereby incorporated by reference in their entirety for all purposes.

BACKGROUND OF THE INVENTION

Women often carry their wallets, cosmetics, combs, and the like in their purses. Likewise, men often carry briefcases. Typically, purses and briefcases have an attractive soft fabric or leather exterior and come in various shapes and styles. However, these purses and briefcases do not protect their contents from being crushed, illuminate their interiors, nor protect the wallets and passports contained within, from unauthorized radio-frequency identification (RFID) readers.

What is needed is a purse that is stylish while solving those problems.

SUMMARY OF THE INVENTION

The present invention provides a metal purse having an interior electroluminescent lighting system. The metal purse is illuminates the interior of the when opened and protects the contents from being crushed and read by from unauthorized radio-frequency identification (RFID) readers.

The present invention provides a metal purse having an interior electroluminescent lighting system. The metal purse includes:

a first metal shell having a first exterior surface, a first interior surface, a first edge, a second edge, and a first interior liner having a first surface and a second surface, wherein the first edge of the first metal shell is parallel to the second edge of the first metal shell, wherein the first interior surface of the first metal shell is adjacent to the first surface of the first liner;

a second metal shell having a second exterior surface, a second interior surface, a first edge, a second edge, and a second interior liner having a first surface and a second surface, wherein the first edge of the second metal shell is parallel the second edge of the second metal shell, wherein the second interior surface of the second metal shell is adjacent to the first surface of the second liner, wherein the first edge of the first metal shell is mechanically coupled to the first edge of the second metal shell to allow for the opening and closing of the first metal shell and the second metal shell;

an optional handle mechanically coupled to the first metal shell, the second metal shell, or to the first metal shell and the second metal shell;

a closure system mechanically coupled to the first metal shell, the second metal shell, or to the first metal shell and the second metal shell to allow for closure of the metal purse such that the second edge of the first metal shell and the second edge of the second metal shell are adjacent when the metal purse is closed;

an on/off switch located on the second surface of the first interior liner, the first interior surface of the first metal shell, or the second surface of the interior liner and the first interior surface of the first metal shell;

a battery power pack located between the first interior surface of the first shell and the first surface of the first interior liner; and one or more electroluminescent light panels each independently located on the second surface of the first interior liner, the second surface of the second interior liner, or on the second surface of the first interior liner and the second surface of the second interior liner, wherein the electroluminescent light panel includes a protective covering including a transparent fabric covering or a transparent plastic covering;

wherein the on/off switch, the battery power pack, and the lighting system are each operatively coupled together with one or more wires.

In one embodiment, the purse includes a clutch, a tote, a briefcase, a handbag, a shoulder bag, or a makeup bag. In one embodiment, the purse includes a clutch. In one embodiment, the purse includes a tote. In one embodiment, the purse includes a briefcase. In one embodiment, the purse includes a handbag. In one embodiment, the purse includes a shoulder bag. In one embodiment, the purse includes a makeup bag.

In one embodiment, the optional handle includes a chain shoulder strap. In one embodiment, the optional handle includes a leather shoulder strap.

In one embodiment, the on/off switch includes a magnetic contact switch. In one embodiment, the on/off switch includes a manual push button on/off switch.

In one embodiment, the electroluminescent light panel is a flexible electroluminescent light panel, a non-flexible, electroluminescent light panel, or a combination thereof. In one embodiment, the electroluminescent light panel is a flexible electroluminescent light panel.

In one embodiment, the first metal shell and the second metal shell each independently include a rigid metal. In one embodiment, the first metal shell and the second metal shell each independently include a flexible metal.

In one embodiment, the closure system includes a metal flap with a lock clasp or a two-piece snap lock.

In one embodiment, first metal shell and the second metal shell are symmetrical. In one embodiment, first metal shell and the second metal shell are not symmetrical.

In one embodiment, the battery power pack includes one or more rechargeable batteries, one or more non-rechargeable batteries, or a combination thereof. In one embodiment, the battery power pack includes one or more rechargeable batteries. In one embodiment, the battery power pack includes one or more non-rechargeable batteries. In one embodiment, the battery power pack includes one or more rechargeable batteries and one or more non-rechargeable batteries.

In one embodiment, the electroluminescent light panel includes an inverter battery, an inverter, and one or more electroluminescent materials.

The present invention provides a rigid metal purse having an interior electroluminescent lighting system. The rigid metal purse includes:

a rigid first metal shell having a first exterior surface, a first interior surface, a first edge, a second edge, and a first interior liner having a first surface and a second surface, wherein the first edge of the first rigid metal shell is parallel to the second edge of the first rigid metal shell, wherein the first interior surface of the first rigid metal shell is adjacent to the first surface of the first liner;

a rigid second metal shell having a second exterior surface, a second interior surface, a first edge, a second edge, and a second interior liner having a first surface and a second surface, wherein the first edge of the second rigid metal shell is parallel the second edge of the second rigid metal shell, wherein the second interior surface of the second rigid metal shell is adjacent to the first surface of the second liner, wherein the first edge of the first rigid metal shell is mechanically coupled to the first edge of the second rigid metal shell to allow for the opening and closing of the first rigid metal shell and the second rigid metal shell;

an optional handle mechanically coupled to the first rigid metal shell, the second rigid metal shell, or to the first rigid metal shell and the second rigid metal shell;

a closure system mechanically coupled to the first rigid metal shell, the second rigid metal shell, or to the first rigid metal shell and the second rigid metal shell to allow for closure of the rigid metal purse such that the second edge of the first rigid metal shell and the second edge of the second rigid metal shell are adjacent when the rigid metal purse is closed, wherein the closure system includes a metal flap with a lock clasp or a two-piece snap lock;

an manual push button on/off switch located on the second surface of the first interior liner, the first interior surface of the first rigid metal shell, or the second surface of the interior liner and the first interior surface of the first rigid metal shell;

a battery power pack located between the first interior surface of the first shell and the first surface of the first interior liner; and one or more flexible electroluminescent light panels each independently located on the second surface of the first interior liner, the second surface of the second interior liner, or on the second surface of the first interior liner and the second surface of the second interior liner, wherein the flexible electroluminescent light panel includes a protective covering including a transparent fabric covering or a transparent plastic covering;

wherein the manual push button on/off switch, the battery power pack, and the lighting system are each operatively coupled together with one or more wires.

The present invention provides a rigid metal purse having an interior electroluminescent lighting system. The rigid metal purse includes:

a first rigid metal shell having a first exterior surface, a first interior surface, a first edge, a second edge, and a first interior liner having a first surface and a second surface, wherein the first edge of the first rigid metal shell is parallel to the second edge of the first rigid metal shell, wherein the first interior surface of the first rigid metal shell is adjacent to the first surface of the first liner;

a second rigid metal shell having a second exterior surface, a second interior surface, a first edge, a second edge, and a second interior liner having a first surface and a second surface, wherein the first edge of the second rigid metal shell is parallel the second edge of the second rigid metal shell, wherein the second interior surface of the second rigid metal shell is adjacent to the first surface of the second liner, wherein the first edge of the first rigid metal shell is mechanically coupled to the first edge of the second rigid metal shell to allow for the opening and closing of the first rigid metal shell and the second rigid metal shell;

an optional handle mechanically coupled to the first rigid metal shell, the second rigid metal shell, or to the first rigid metal shell and the second rigid metal shell;

a closure system mechanically coupled to the first rigid metal shell, the second rigid metal shell, or to the first rigid metal shell and the second rigid metal shell to allow for closure of the rigid metal purse such that the second edge of the first rigid metal shell and the second edge of the second rigid metal shell are adjacent when the rigid metal purse is closed, wherein the closure system includes a metal flap with a lock clasp or a two-piece snap lock;

an magnetic contact on/off switch located on the second surface of the first interior liner, the first interior surface of the first rigid metal shell, or the second surface of the interior liner and the first interior surface of the first rigid metal shell;

a battery power pack located between the first interior surface of the first shell and the first surface of the first interior liner; and one or more flexible electroluminescent light panels each independently located on the second surface of the first interior liner, the second surface of the second interior liner, or on the second surface of the first interior liner and the second surface of the second interior liner, wherein the flexible electroluminescent light panel includes a protective covering including a transparent fabric covering or a transparent plastic covering;

wherein the magnetic contact on/off switch, the battery power pack, and the lighting system are each operatively coupled together with one or more wires.

BRIEF DESCRIPTION OF THE DRAWINGS

Embodiments of the invention may be best understood by referring to the following description and accompanying drawings, which illustrate such embodiments. In the drawings.

Figure 1:
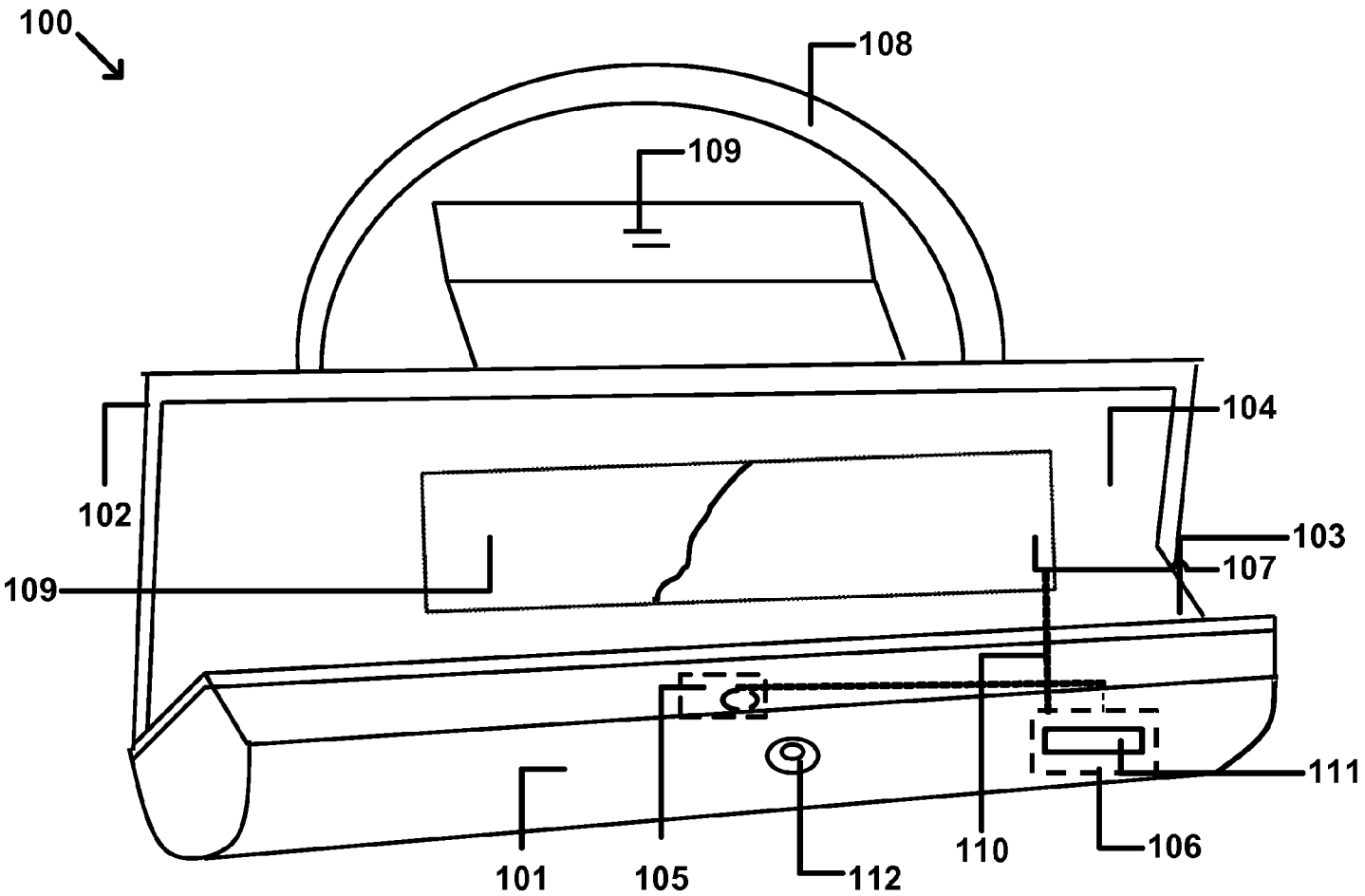
FIG. 1 is a perspective side drawing illustrating an exemplary metal purse.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a metal purse having an interior electroluminescent lighting system. The metal purse is illuminates the interior of the when opened and protects the contents from being crushed and read by from unauthorized radio-frequency identification (RFID) readers.

The present invention provides a metal purse having an interior electroluminescent lighting system. The metal purse includes: a metal shell having an exterior surface, an interior surface, and an interior liner having a first surface and a second surface; an on/off switch located on the first surface of the interior liner, the interior surface of the metal purse, or the first surface of the interior liner and the interior surface of the metal purse; a battery power pack located between the interior surface of the metal purse and the second surface of interior liner; and an electroluminescent light panel located on the first surface of the interior liner, wherein the electroluminescent light panel includes a protective covering including a transparent fabric covering or a transparent plastic covering; wherein the on/off switch, the battery power pack, and the lighting system are each electrically coupled together with one or more wires each independently located on the second surface of the interior liner or between the second surface of the interior liner and the interior surface of the metal purse.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein the phrase "battery pack" refers to a set of any number of (preferably) identical batteries or individual battery cells.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "purse" refers to a container made of paper, cloth, mesh, metal, plastic or other flexible material.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the phrase "mechanically coupled" refers to bringing two or more items together or into relationship with each other in any number of ways including a direct or indirect physical connection that may be releasable (snaps, rivets, screws, bolts, welds, etc.), movable (rotating, pivoting, oscillating, etc.), or a combination thereof.

As used herein, the phrase "operatively coupled" refers to bringing two or more items together or into relationship with each other such that they may operate together or allow transfer of information between the two or more items.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As defined within, the term "purse" refers to a receptacle, such as a handbag, pocketbook, or wallet that is used by a person to carry money and other small objects. As such, a purse can include, for example, a clutch, a tote, a briefcase, a handbag, a shoulder bag, or a makeup bag.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

FIG. 1 is a perspective side drawing illustrating an exemplary metal purse 100. The metal purse 100 includes a first metal shell 101, a second metal shell 102, a first interior liner 103, a second interior liner 104, a manual push-button on/off switch 105, a battery power pack 106, an electroluminescent light panel 107, an optional handle 108, and a latch 109. The battery power pack 106 is located between the interior surface of first metal shell 101 and the first surface of the interior liner 103. The electroluminescent light panel 107 is located on the second surface of the second interior liner 104.

In one embodiment, first metal shell 101 and the second metal shell 102 are symmetrical. In one embodiment, first metal shell 101 and the second metal shell 102 are not symmetrical.

In one embodiment, the electroluminescent light panel 107 includes a protective covering 109. In one embodiment, the protective covering 109 includes a transparent fabric covering. In one embodiment, the protective covering 109 includes a transparent plastic covering.

The manual push-button on/off switch 105, the battery power pack 106, and the electroluminescent light panel 107 are each electrically coupled together with one or more wires 110. The battery power pack 106 includes one or more batteries 111. In one embodiment, the one or more batteries 111 are rechargeable batteries. In one embodiment, the one or more batteries 111 are non-rechargeable batteries.

In one embodiment, the electroluminescent light panel 107 is a flexible electroluminescent light panel. In one embodiment, the electroluminescent light panel 107 is non-flexible, electroluminescent light panel. In one embodiment, the electroluminescent light panel 107 includes an inverter battery (not shown), an inverter (not shown), and one or more electroluminescent materials (not shown).

In one embodiment, the first metal shell 101 and the second metal shell 102 are each a rigid metal shell. In one embodiment, the first metal shell 101 and the second metal shell 102 are each a flexible metal shell.

In one embodiment, the optional handle 108 is a flexible optional handle. In one embodiment, the optional handle 108 is a rigid optional handle. The rigid optional handle may be a rigid metal optional handle, a rigid wood optional handle, a rigid plastic optional handle, or the like. In one embodiment, the optional handle 108 is a flexible optional handle. The flexible optional handle may be made of chain. The chain may be metal, wood, plastic, or the like.

The latch 109 is used to secure the contents of the metal purse 100 by interfacing with notch 112 after the purse is closed.

When the purse is open, the user depresses the manual push-button on/off switch 105 and the power flows from the battery power pack 106 to electroluminescent light panel 107 that lights up the interior of the metal purse 100.

Figure 2:
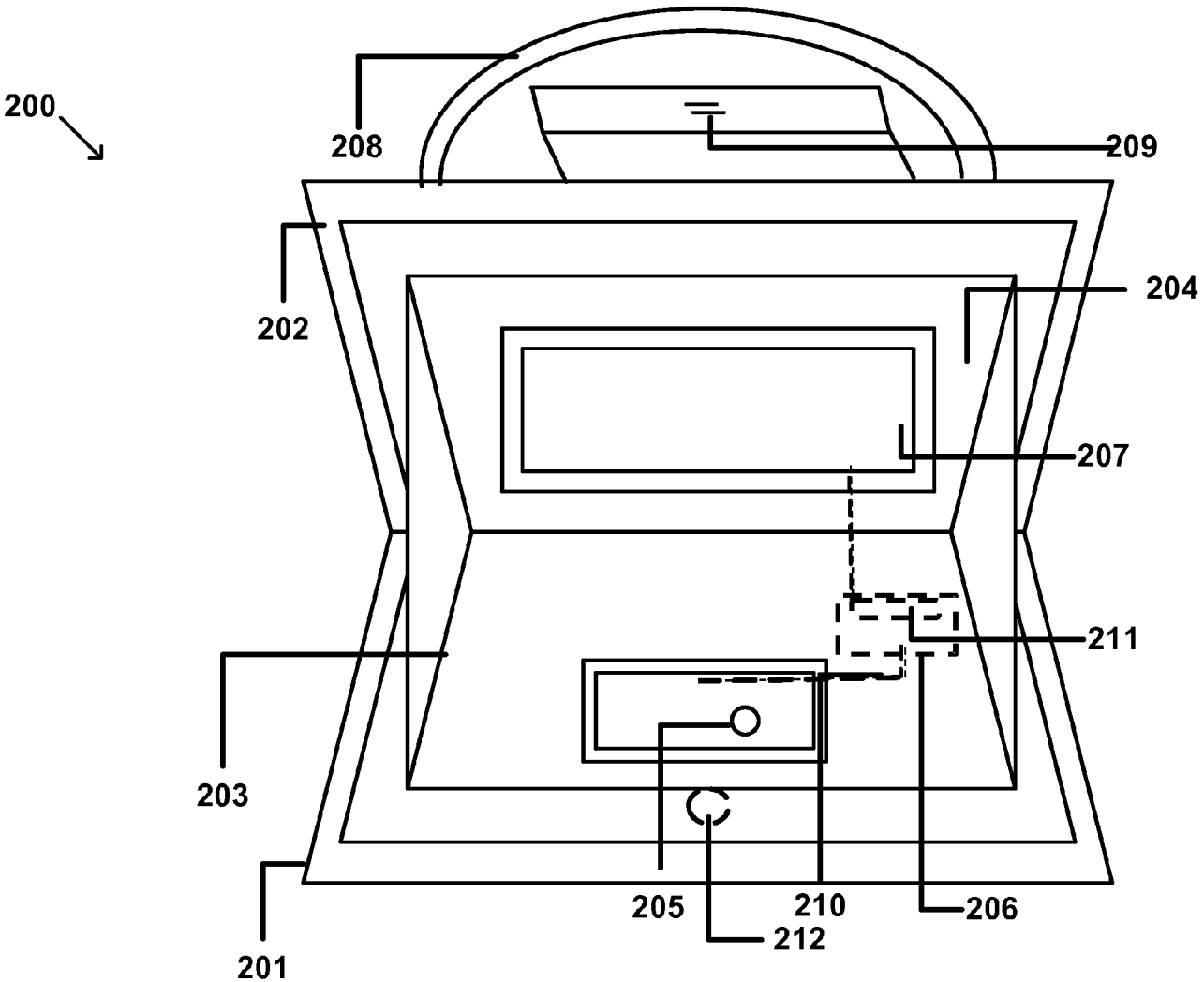
FIG. 2 is a top-view drawing illustrating an exemplary metal purse.

FIG. 2 is a top-view drawing illustrating an exemplary metal purse 200. The metal purse 200 includes a first metal shell 201, a second metal shell 202, a first interior liner 203, a second interior liner 204, a manual push-button on/off switch 205, a battery power pack 206, an electroluminescent light panel 207, an optional handle 208, and a latch 209. The manual push-button on/off switch 205, the battery power pack 206, and the electroluminescent light panel 207 are each electrically coupled together with one or more wires 210. In one embodiment, the battery power pack 206 includes one or more batteries 211.

In one embodiment, first metal shell 201 and the second metal shell 202 are symmetrical. In one embodiment, first metal shell 201 and the second metal shell 202 are not symmetrical. The latch 209 is used to secure the contents of the metal purse 200 by interfacing with notch 212 after the purse is closed. When the metal purse 200 is open, the user depresses the manual push-button on/off switch 205 and the power flows from the battery power pack 206 to electroluminescent light panel 207 that lights up the interior of the metal purse 200.

Figure 3:
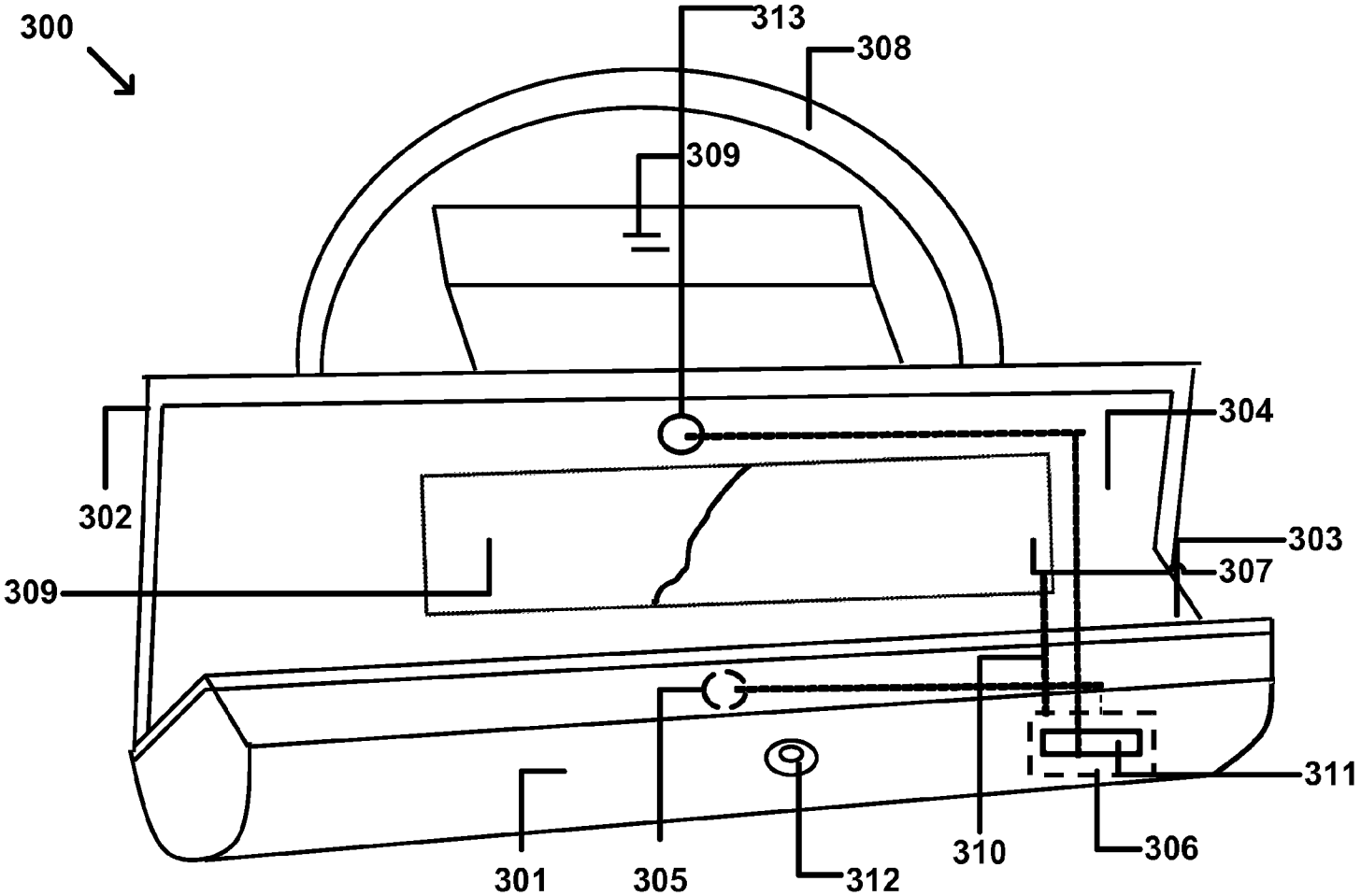
FIG. 3 is a perspective side drawing illustrating an exemplary metal purse.

FIG. 3 is a perspective side drawing illustrating an exemplary metal purse 300. The metal purse 300 includes a first metal shell 301, a second metal shell 302, a first interior liner 303, a second interior liner 304, magnetic contact on/off switch 305, a battery power pack 306, an electroluminescent light panel 307, an optional handle 308, and a latch 309.

The battery power pack 306 is located between the interior surface of first metal shell 301 and the first surface of the interior liner 303. The electroluminescent light panel 307 is located on the second surface of the second interior liner 304. In one embodiment, the electroluminescent light panel 307 includes a protective covering 309. In one embodiment, the protective covering 309 includes a transparent fabric covering. In one embodiment, the protective covering 309 includes a transparent plastic covering.

In one embodiment, first metal shell 301 and the second metal shell 302 are symmetrical. In one embodiment, first metal shell 301 and the second metal shell 302 are not symmetrical.

The magnetic contact switch 305, the battery power pack 306, and the electroluminescent light panel 307 are each electrically coupled together with one or more wires 310. The battery power pack 306 includes one or more batteries 311.

The latch 309 is used to secure the contents of the metal purse 300 by interfacing with notch 312 after the purse is closed. When the purse is open, the connection between the magnetic contact on/off switch 305 and the magnetic contact connector 313 is broken and the power flows from the battery power pack 306 to electroluminescent light panel 307 and lights up the interior of the metal purse 300.

Figure 4:
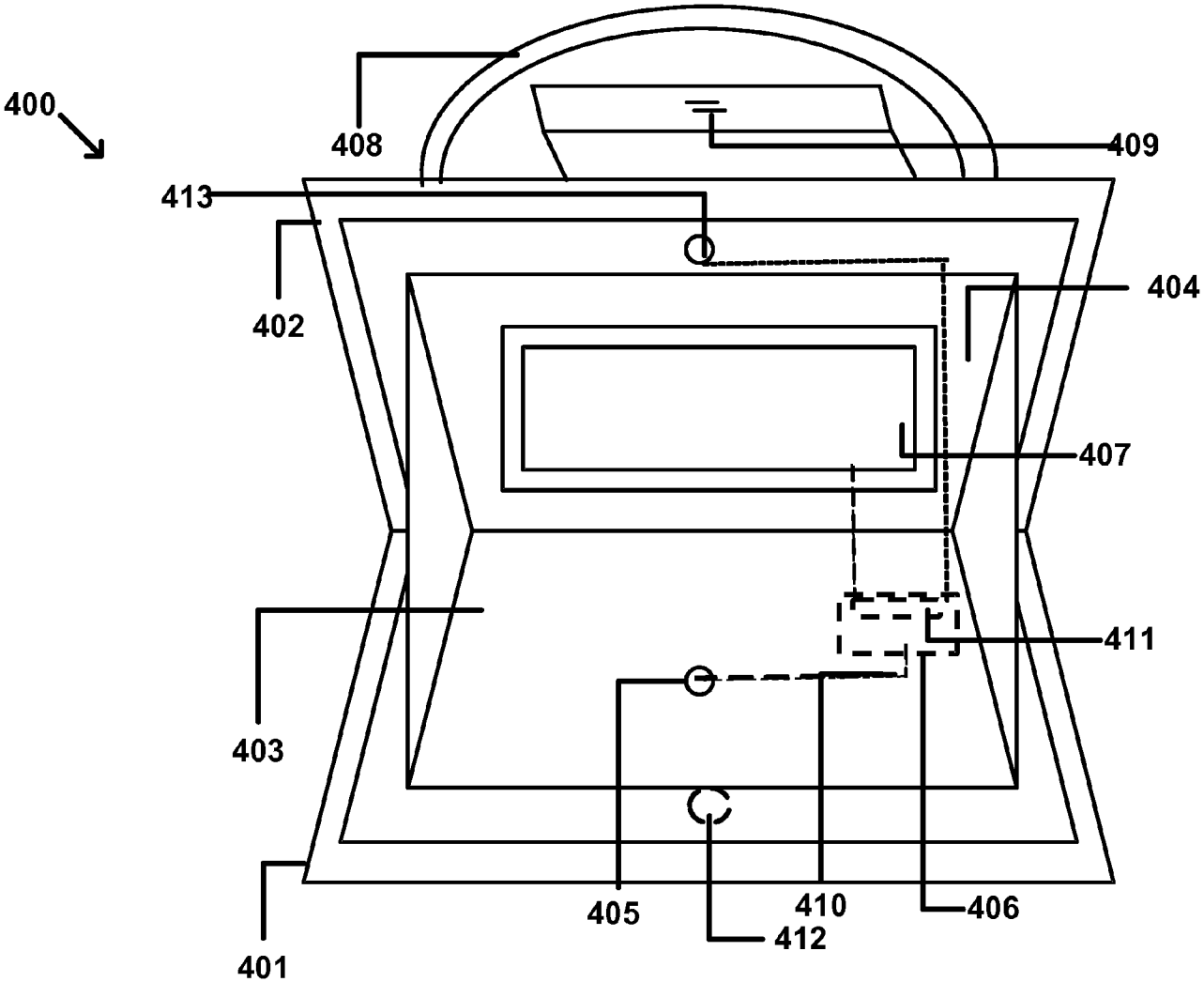
FIG. 4 is a top-view drawing illustrating an exemplary metal purse.

FIG. 4 is a top-view drawing illustrating an exemplary metal purse 400. The metal purse 400 includes a first metal shell 401, a second metal shell 402, a first interior liner 403, a second interior liner 404, magnetic contact on/off switch 405, a battery power pack 406, an electroluminescent light panel 407, an optional handle 408, and a latch 409.

The battery power pack 406 is located between the interior surface of first metal shell 401 and the first surface of the interior liner 403. The electroluminescent light panel 407 is located on the second surface of the second interior liner 404. In one embodiment, first metal shell 401 and the second metal shell 402 are symmetrical. In one embodiment, first metal shell 401 and the second metal shell 402 are not symmetrical.

The magnetic contact switch 405, the battery power pack 406, and the electroluminescent light panel 407 are each electrically coupled together with one or more wires 410. The battery power pack 406 includes one or more batteries 411.

The latch 409 is used to secure the contents of the metal purse 400 by interfacing with notch 412 after the purse is closed. When the purse is open, the connection between the magnetic contact on/off switch 405 and the magnetic contact connector 413 is broken and the power flows from the battery power pack 406 to electroluminescent light panel 407 and lights up the interior of the metal purse 400.

Figure 5:
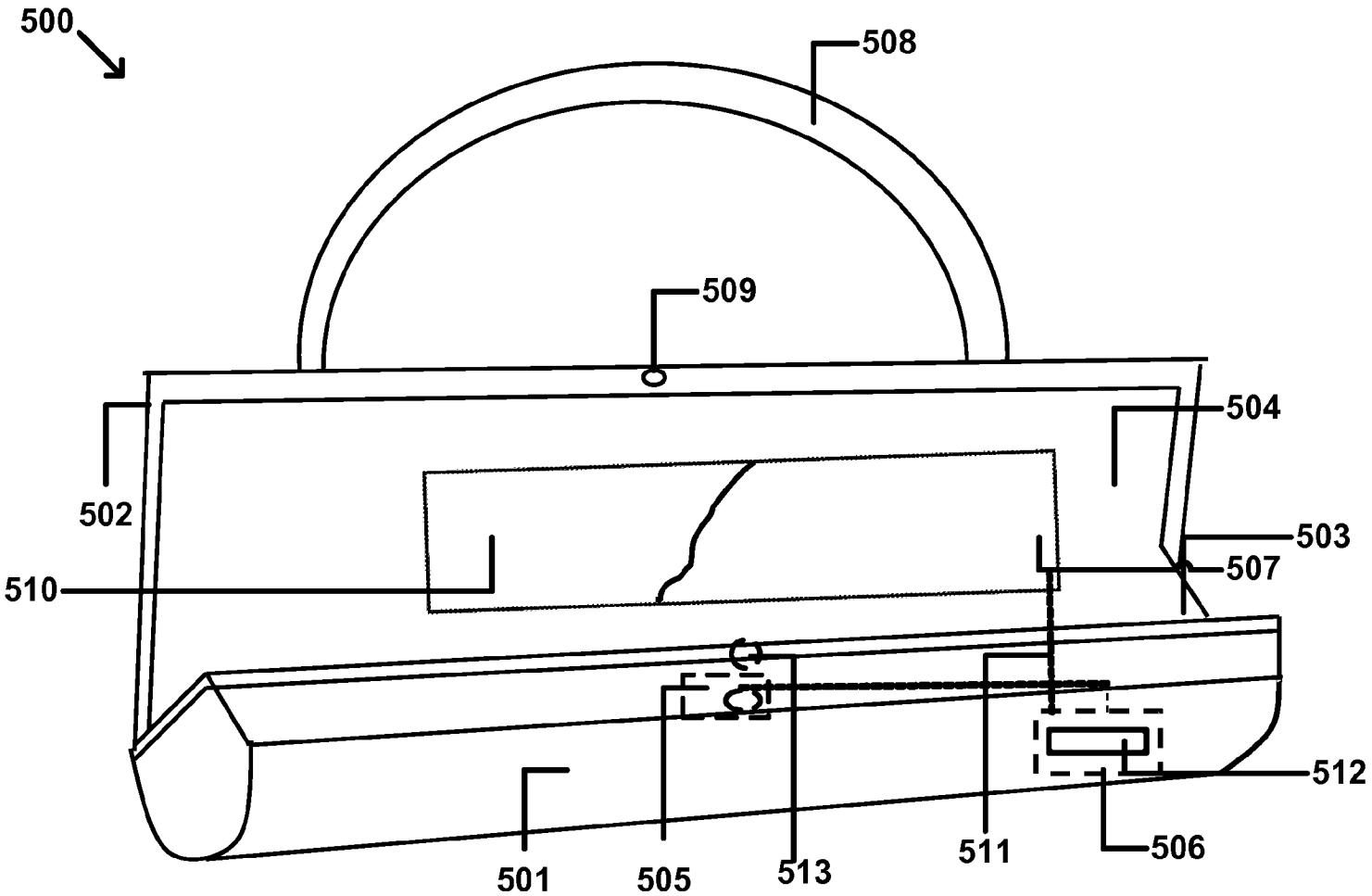
FIG. 5 is a perspective side drawing illustrating an exemplary metal purse.

FIG. 5 is a perspective side drawing illustrating an exemplary metal purse 500. The metal purse 500 includes a first metal shell 501, a second metal shell 502, a first interior liner 503, a second interior liner 504, manual push button on/off switch 505, a battery power pack 506, an electroluminescent light panel 507, an optional handle 508, and a latch 509.

The battery power pack 506 is located between the interior surface of first metal shell 501 and the first surface of the interior liner 503. The electroluminescent light panel 507 is located on the second surface of the second interior liner 504. In one embodiment, the electroluminescent light panel 507 includes a protective covering 510. In one embodiment, the protective covering 510 includes a transparent fabric covering. In one embodiment, the protective covering 510 includes a transparent plastic covering.

In one embodiment, first metal shell 501 and the second metal shell 502 are symmetrical. In one embodiment, first metal shell 501 and the second metal shell 502 are not symmetrical.

The manual push button on/off switch 505, the battery power pack 506, and the electroluminescent light panel 507 are each electrically coupled together with one or more wires 511. The battery power pack 506 includes one or more batteries 512.

The latch 509 is used to secure the contents of the metal purse 500 by interfacing with notch 513 after the purse is closed. When the purse is open, the user depresses the manual push-button on/off switch 505 and the power flows from the battery power pack 506 to electroluminescent light panel 507 and lights up the interior of the metal purse 500.

Figure 6:
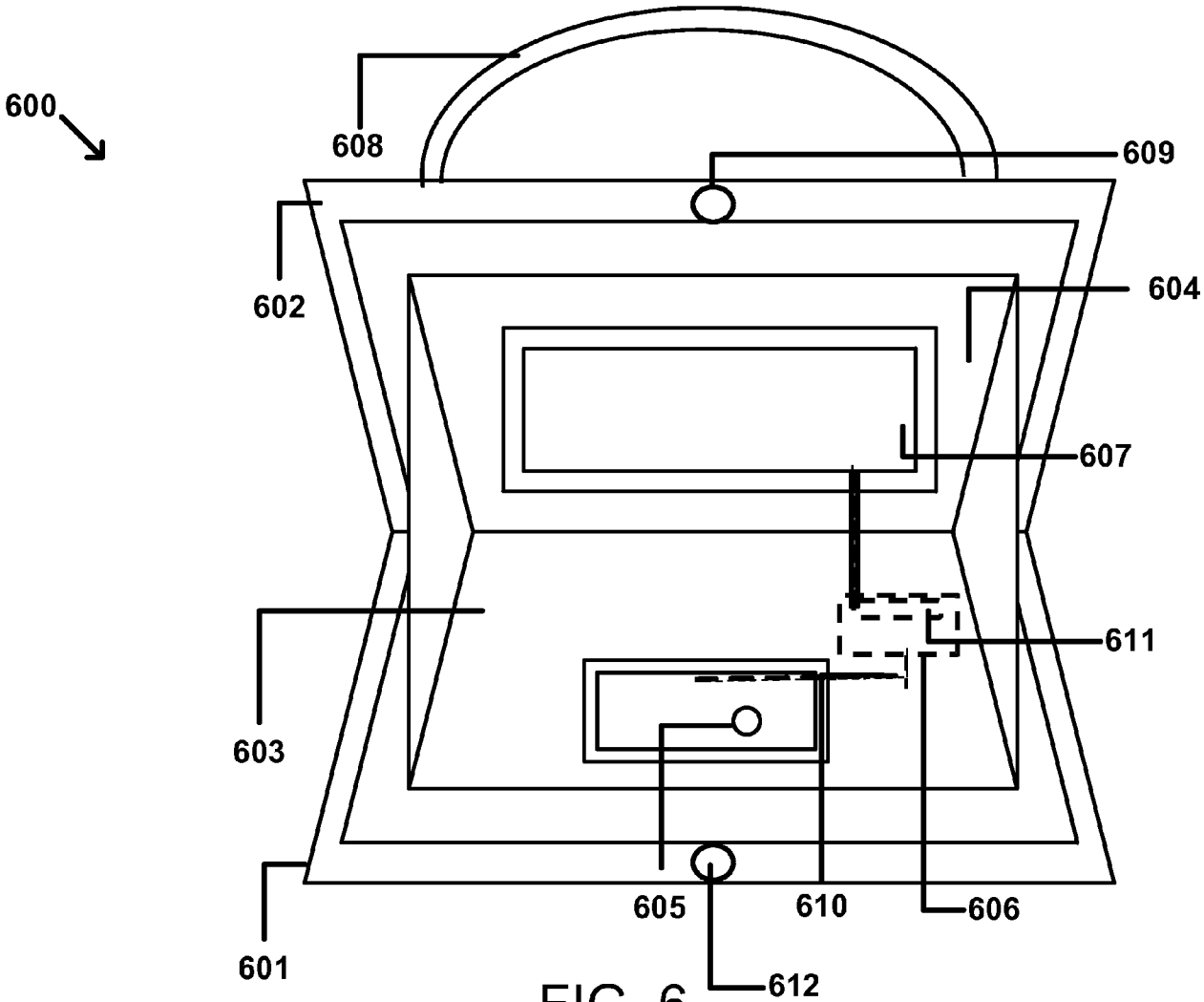
FIG. 6 is a top-view drawing illustrating an exemplary metal purse.

FIG. 6 is a top-view drawing illustrating an exemplary metal purse 600. The metal purse 600 includes a first metal shell 601, a second metal shell 602, a first interior liner 603, a second interior liner 604, manual push button on/off switch 605, a battery power pack 606, an electroluminescent light panel 607, an optional handle 608, and a latch 609.

The battery power pack 606 is located between the interior surface of first metal shell 601 and the first surface of the interior liner 603. The electroluminescent light panel 607 is located on the second surface of the second interior liner 604.

In one embodiment, first metal shell 601 and the second metal shell 602 are symmetrical. In one embodiment, first metal shell 601 and the second metal shell 602 are not symmetrical.

The manual push button on/off switch 605, the battery power pack 606, and the electroluminescent light panel 607 are each electrically coupled together with one or more wires 610. The battery power pack 606 includes one or more batteries 611.

The latch 609 is used to secure the contents of the metal purse 600 by interfacing with notch 612 after the purse is closed. When the purse is open, the user depresses the manual push-button on/off switch 605 and the power flows from the battery power pack 606 to electroluminescent light panel 607 and lights up the interior of the metal purse 600.

Figure 7:
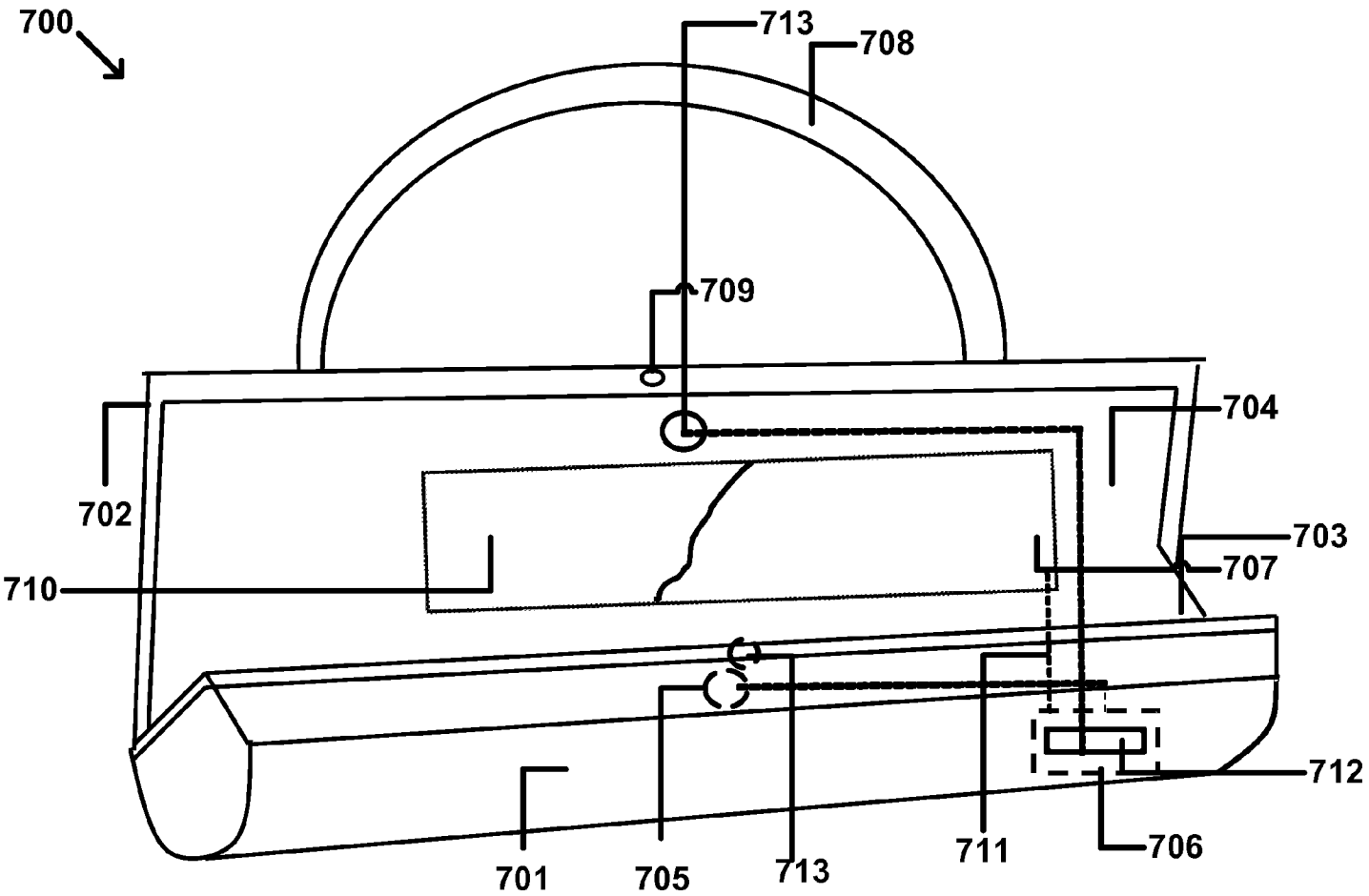
FIG. 7 is a perspective side drawing illustrating an exemplary metal purse.

FIG. 7 is a perspective side drawing illustrating an exemplary metal purse 700. The metal purse 700 includes a first metal shell 701, a second metal shell 702, a first interior liner 703, a second interior liner 704, magnetic contact on/off switch 705, a battery power pack 706, an electroluminescent light panel 707, an optional handle 708, and a latch 709.

The battery power pack 706 is located between the interior surface of first metal shell 701 and the first surface of the interior liner 703. The electroluminescent light panel 707 is located on the second surface of the second interior liner 704. In one embodiment, the electroluminescent light panel 707 includes a protective covering 710.

In one embodiment, first metal shell 701 and the second metal shell 702 are symmetrical. In one embodiment, first metal shell 701 and the second metal shell 702 are not symmetrical.

The magnetic contact on/off switch 705, the battery power pack 706, and the electroluminescent light panel 707 are each electrically coupled together with one or more wires 711. The battery power pack 706 includes one or more batteries 712.

The latch 709 is used to secure the contents of the metal purse 700 by interfacing with notch 713 after the purse is closed. When the purse is open, the connection between the magnetic contact on/off switch 705 and the magnetic contact connector 713 is broken and the power flows from the battery power pack 706 to electroluminescent light panel 707 and lights up the interior of the metal purse 700.

Figure 8:
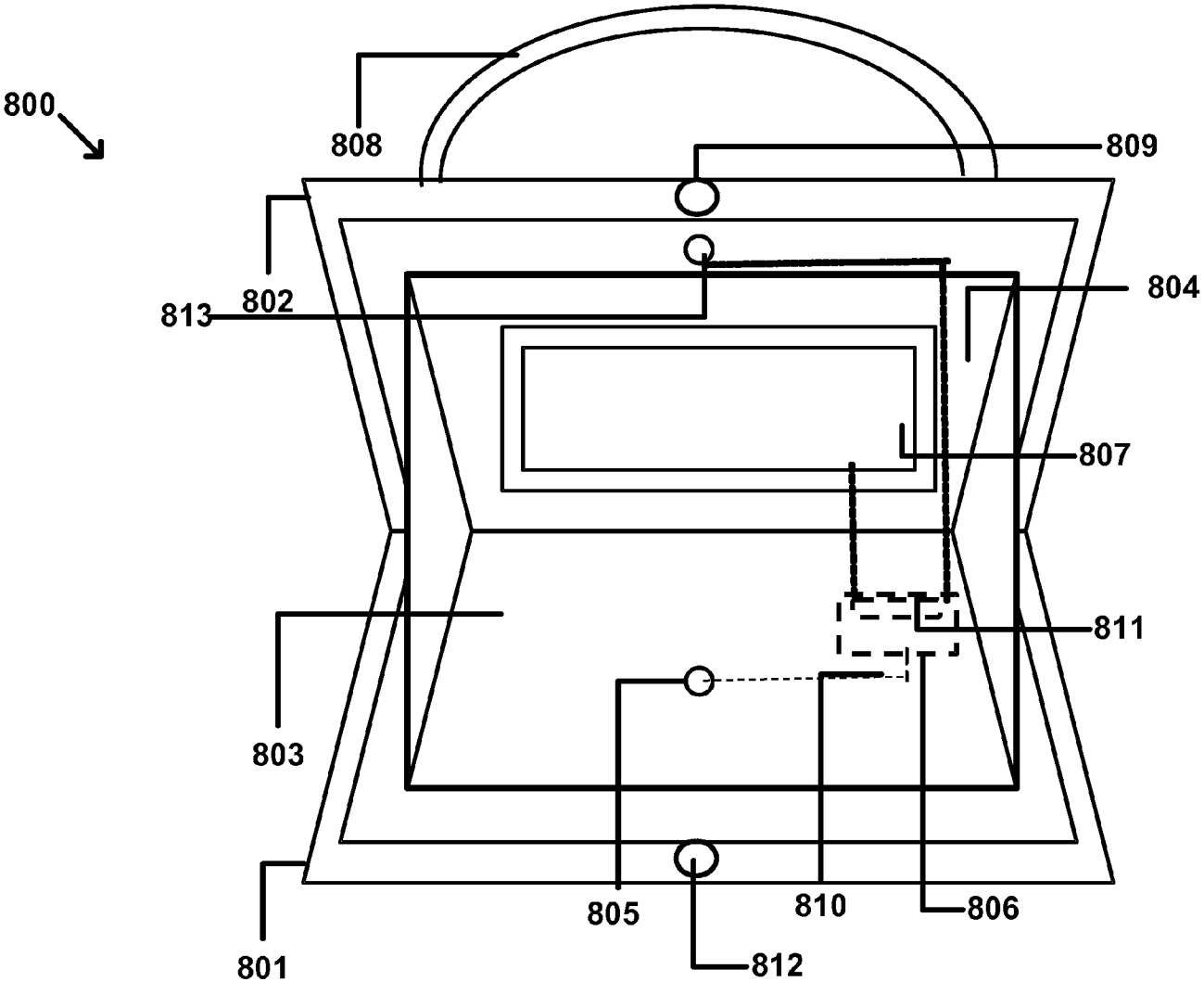
FIG. 8 is a top-view drawing illustrating an exemplary metal purse.

FIG. 8 is a top-view drawing illustrating an exemplary metal purse 800. The metal purse 800 includes a first metal shell 801, a second metal shell 802, a first interior liner 803, a second interior liner 804, magnetic contact on/off switch 805, a battery power pack 806, an electroluminescent light panel 807, an optional handle 808, and a latch 809.

The battery power pack 806 is located between the interior surface of first metal shell 801 and the first surface of the interior liner 803. The electroluminescent light panel 807 is located on the second surface of the second interior liner 804.

In one embodiment, first metal shell 801 and the second metal shell 802 are symmetrical. In one embodiment, first metal shell 801 and the second metal shell 802 are not symmetrical.

The magnetic contact on/off switch 805, the battery power pack 806, and the electroluminescent light panel 807 are each electrically coupled together with one or more wires 810. The battery power pack 806 includes one or more batteries 811.

The latch 809 is used to secure the contents of the metal purse 800 by interfacing with notch 812 after the purse is closed. When the purse is open, the connection between the magnetic contact on/off switch 805 and the magnetic contact connector 813 is broken and the power flows from the battery power pack 806 to electroluminescent light panel 807 and lights up the interior of the metal purse 800.

Figure 9:
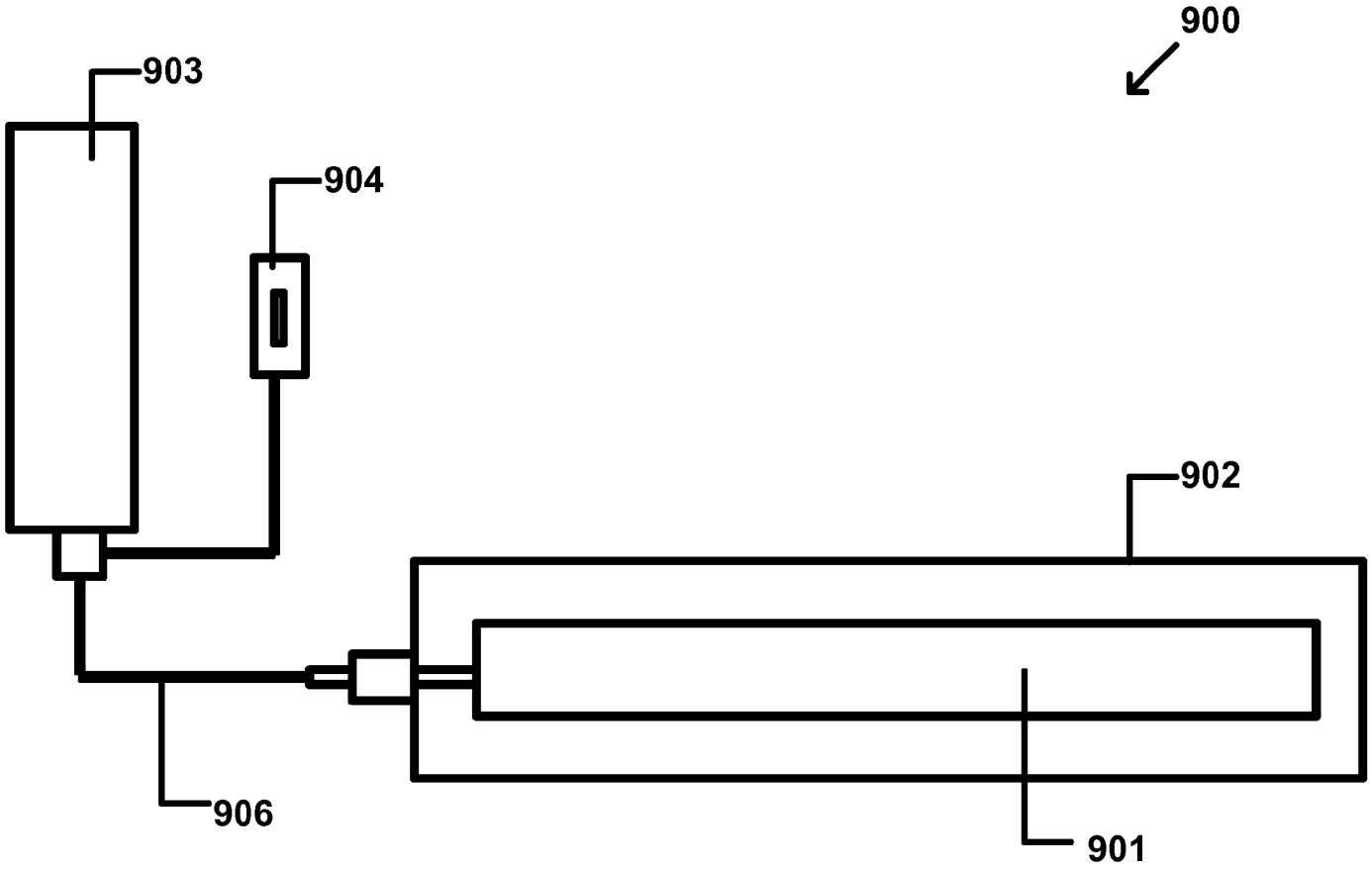
FIG. 9 illustrates an exemplary electroluminescent lighting system used in an exemplary metal purse.

FIG. 9 illustrates an exemplary electroluminescent lighting system 900. The electroluminescent lighting system 900 includes an electroluminescent light panel 901, a transparent protective cover 902, a power system 903, a magnetic contact switch 904, and wires 905 that connect the power system 903 to the electroluminescent light panel 901 and the magnetic contact switch 904, respectively. The power system 903 includes a battery pack 905 (not shown) and a controller 906 (not shown). The controller 906 includes an integrated circuit board 907 (not shown) that regulates the power flowing from the battery pack 905 (not shown) to the electroluminescent light panel 901. The electroluminescent light panel 901 includes an inverter battery 908 (not shown), an inverter 909 (not shown), and one or more electroluminescent materials 910 (not shown). The electroluminescent lighting system 900 may be a variety of commercially available electroluminescent lighting systems.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A metal purse having an interior electroluminescent lighting system comprising:

a radio-frequency identification reader protector;

a first metal shell having a first exterior surface, a first interior surface, a first edge, a second edge, and a first interior liner having a first surface and a second surface, wherein the first edge of the first metal shell is parallel to the second edge of the first metal shell, wherein the first interior surface of the first metal shell is adjacent to the first surface of the first liner;

a second metal shell having a second exterior surface, a second interior surface, a first edge, a second edge, and a second interior liner having a first surface and a second surface, wherein the first edge of the second metal shell is parallel the second edge of the second metal shell, wherein the second interior surface of the second metal shell is adjacent to the first surface of the second liner, wherein the first edge of the first metal shell is mechanically coupled to the first edge of the second metal shell to allow for an opening and closing of the first metal shell and the second metal shell;

an optional handle mechanically coupled to the first metal shell, the second metal shell, or to the first metal shell and the second metal shell;

a closure system mechanically coupled to the first metal shell, the second metal shell, or to the first metal shell and the second metal shell to allow for closure of the metal purse such that the second edge of the first metal shell and the second edge of the second metal shell are adjacent when the metal purse is closed;

a removeably attached battery power pack, with an on/off switch, and inverter located on the first interior fabric surface of the first metal shell and one or more electroluminescent light panels each independently located on the second surface of the second shell, wherein the second surface has an attached transparent plastic protective covering that the electroluminescent light panel securely fits behind, and wherein the on/off switch, the battery power pack, and the lighting system are each operatively coupled together with one or more wires.

2. The metal purse having the interior electroluminescent lighting system of claim 1, wherein the purse comprises a clutch, a tote, a briefcase, a handbag, a shoulder bag, or a makeup bag.

3. The metal purse having the interior electroluminescent lighting system of claim 1, wherein the on/off switch comprises a magnetic contact switch.

4. The metal purse having the interior electroluminescent lighting system of claim 1, wherein the on/off switch comprises a manual push button on/off switch.

5. The metal purse having the interior electroluminescent lighting system of claim 1, wherein the electroluminescent light panel is a flexible electroluminescent light panel, a non-flexible, electroluminescent light panel, or a combination thereof.

6. The metal purse having the interior electroluminescent lighting system of claim 5, wherein the electroluminescent light panel is a flexible electroluminescent light panel.

7. The metal purse having the interior electroluminescent lighting system of claim 1, wherein the first metal shell and the second metal shell each independently comprise a rigid metal.

8. The metal purse having the interior electroluminescent lighting system of claim 1, wherein the first metal shell and the second metal shell each independently comprise a flexible metal.

9. The metal purse having the interior electroluminescent lighting system of claim 1, wherein the closure system comprises a metal flap with a lock clasp or a two-piece snap lock.

10. The metal purse having the interior electroluminescent lighting system of claim 1, wherein first metal shell and the second metal shell are symmetrical.

11. The metal purse having the interior electroluminescent lighting system of claim 1, wherein first metal shell and the second metal shell are not symmetrical.

12. A rigid metal purse having an interior electroluminescent lighting system comprising:

a radio-frequency identification reader protector;

a rigid first metal shell having a first exterior surface, a first interior surface, a first edge, a second edge, and a first interior liner having a first surface and a second surface, wherein the first edge of the first rigid metal shell is parallel to the second edge of the first rigid metal shell, wherein the first interior surface of the first rigid metal shell is adjacent to the first surface of the first liner;

a rigid second rigid metal shell having a second exterior surface, a second interior surface, a first edge, a second edge, and a second interior liner having a first surface and a second surface, wherein the first edge of the second rigid metal shell is parallel the second edge of the second rigid metal shell, wherein the second interior surface of the second rigid metal shell is adjacent to the first surface of the second liner, wherein the first edge of the first rigid metal shell is mechanically coupled to the first edge of the second rigid metal shell to allow for an opening and closing of the first rigid metal shell and the second rigid metal shell;

an optional handle mechanically coupled to the first rigid metal shell, the second rigid metal shell, or to the first rigid metal shell and the second rigid metal shell;

a closure system mechanically coupled to the first rigid metal shell, the second rigid metal shell, or to the first rigid metal shell and the second rigid metal shell to allow for closure of the rigid metal purse such that the second edge of the first rigid metal shell and the second edge of the second rigid metal shell are adjacent when the rigid metal purse is closed, wherein the closure system comprises a metal flap with a lock clasp or a two-piece snap lock;

a manual push button on/off switch located on the second surface of the first interior liner, the first interior surface of the first rigid metal shell, or the second surface of the interior liner and the first interior surface of the first rigid metal shell;

a battery power pack located between the first interior surface of the first shell and the first surface of the first interior liner;

one or more flexible electroluminescent light panels each independently located on the second surface of the first interior liner, the second surface of the second interior liner, or on the second surface of the first interior liner and the second surface of the second interior liner, wherein the second surface has an attached transparent plastic protective covering that the flexible electroluminescent light panel securely fits behind, and wherein the manual push button on/off switch, the battery power pack, and the lighting system are each operatively coupled together with one or more wires.

13. The rigid metal purse having the interior electroluminescent lighting system of claim 12, wherein the purse comprises a clutch, a tote, a briefcase, a handbag, a shoulder bag, or a makeup bag.

14. The rigid metal purse having the interior electroluminescent lighting system of claim 12, wherein first rigid metal shell and the second rigid metal shell are symmetrical.

15. The rigid metal purse having the interior electroluminescent lighting system of claim 12, wherein first rigid metal shell and the second rigid metal shell are not symmetrical.

16. A rigid metal purse having an interior electroluminescent lighting system comprising:

a radio-frequency identification reader protector;

a rigid first metal shell having a first exterior surface, a first interior surface, a first edge, a second edge, and a first interior liner having a first surface and a second surface, wherein the first edge of the first rigid metal shell is parallel to the second edge of the first rigid metal shell, wherein the first interior surface of the first rigid metal shell is adjacent to the first surface of the first liner;

a rigid second rigid metal shell having a second exterior surface, a second interior surface, a first edge, a second edge, and a second interior liner having a first surface and a second surface, wherein the first edge of the second rigid metal shell is parallel the second edge of the second rigid metal shell, wherein the second interior surface of the second rigid metal shell is adjacent to the first surface of the second liner, wherein the first edge of the first rigid metal shell is mechanically coupled to the first edge of the second rigid metal shell to allow for an opening and closing of the first rigid metal shell and the second rigid metal shell;

an optional handle mechanically coupled to the first rigid metal shell, the second rigid metal shell, or to the first rigid metal shell and the second rigid metal shell;

a closure system mechanically coupled to the first rigid metal shell, the second rigid metal shell, or to the first rigid metal shell and the second rigid metal shell to allow for closure of the rigid metal purse such that the second edge of the first rigid metal shell and the second edge of the second rigid metal shell are adjacent when the rigid metal purse is closed, wherein the closure system comprises a metal flap with a lock clasp or a two-piece snap lock;

an magnetic contact on/off switch located on the second surface of the first interior liner, the first interior surface of the first rigid metal shell, or the second surface of the interior liner and the first interior surface of the first rigid metal shell; a battery power pack located between the first interior surface of the first shell and the first surface of the first interior liner;

one or more flexible electroluminescent light panels each independently located on the second surface of the first interior liner, the second surface of the second interior liner, or on the second surface of the first interior liner and the second surface of the second interior liner, wherein the second surface has an attached transparent plastic protective covering that the flexible electroluminescent light panel securely fits behind, and wherein the magnetic contact on/off switch, the battery power pack, and the lighting system are each operatively coupled together with one or more wires.

17. The rigid metal purse having the interior electroluminescent lighting system of claim 16, wherein the purse comprises a clutch, a tote, a briefcase, a handbag, a shoulder bag, or a makeup bag.

18. The rigid metal purse having the interior electroluminescent lighting system of claim 16, wherein first rigid metal shell and the second rigid metal shell are symmetrical.

19. The rigid metal purse having the interior electroluminescent lighting system of claim 16, wherein first rigid metal shell and the second rigid metal shell are not symmetrical.

* * * * *